United States Patent [19]

Greenberg

[11] 4,018,441

[45] Apr. 19, 1977

[54] JUMP-ROPE TRAINING EXERCISE DEVICE

[76] Inventor: Howard Greenberg, 97 Allen St., New York, N.Y. 10002

[22] Filed: Nov. 7, 1975

[21] Appl. No.: 629,705

[52] U.S. Cl. ..... 272/75; 2/18

[51] Int. Cl.[2] ..... A63B 5/22

[58] Field of Search ..... 272/74, 75; 273/26 E, 273/95 A, 58 C; 46/1 G; 2/16, 17, 18

[56] References Cited

UNITED STATES PATENTS

| | | | |
|---|---|---|---|
| 554,992 | 2/1896 | Donnellan | 272/75 |
| 3,189,346 | 6/1965 | Miguez | 272/7 X |
| 3,731,927 | 5/1973 | Rocco, Jr. | 273/26 E |

FOREIGN PATENTS OR APPLICATIONS

| | | | |
|---|---|---|---|
| 795,589 | 3/1936 | France | 293/95 A |

*Primary Examiner*—Richard C. Pinkham
*Attorney, Agent, or Firm*—Nathaniel Altman

[57] ABSTRACT

A training and exercise device combining a jump-rope with a pair of hand-covering elements, such as boxing training gloves, mittens or the like, provided with means for releasably connecting one end of the jump-rope to each of the hand-covering elements.

6 Claims, 7 Drawing Figures

JUMP-ROPE TRAINING EXERCISE DEVICE

BACKGROUND OF THE INVENTION

Rope-jumping has been long recognized as an ideal form of exercise, both for athletic training and enjoyable diversion for children. Athletics in training find jumping rope an indispensable tool in developing strength and endurance in their legs, and for improving timing coordination and agility.

The conventional jump-rope may be at times somewhat inconvenient or awkward to use. A prime example of this is the case of a boxer wearing training gloves for bag-punching who wishes to alternate or to combine his punching practice with jumping rope—he must either take the time and trouble to remove his bag-punching gloves and to locate the jump-rope, or awkwardly try to grasp firmly the handles of the standard rope with his gloves on.

Another problem may be confronted by the athlete "working out" in low-temperature weather where his choice may be between cold-numbed hands and gloves which prevent a sure non-slip grip on the normal handles of a jump-rope. Still another difficulty may be encountered by the child learning to jump rope whose hands are deficient in size or strength to achieve full control over the customary rope handles.

This invention is directed toward overcoming the above mentioned inconveniences and difficulties, and provides a novel training exercise jump-rope device of broadened convenience and utility.

SUMMARY OF THE INVENTION

The present invention contemplates the novel combination of a pair of gloves of any description, or mittens, with a jump-rope, the ends of which are releasably secured, one to each glove, by a suitable coupling means.

By use of this device, the boxing trainee may combine and coordinate bag-punching practice with rope-jumping, resulting in improved timing and reflexive response and greater training efficiency. He may punch the bag at will with no interference from the rope positioned behind him and then with one step backward, is instantly ready to proceed with jumping the rope. One step forward and the boxer may resume punching without lost time or motion. The smoother movement and increased mobility encouraged by such intensified dually interwoven exercise training sessions are clearly beneficial and desirable goals to be achieved by the boxer using this invention, which, in addition, permits him to maintain his hands in normal punching position, or even to flex his hands freely at any time without dropping the rope.

The advantages which accrue to toher athletes and learning children jumping rope while wearing the gloves or mittens of this invention are obvious. Hands are protected from cold and from the roughening effects of abrasion from the handles of the conventional jump-rope. During jumping, the hands may be held in relaxed, open position or, optionally, each glove or mitten may be provided with an internal gripping element incorporated within the hand-covering and designed to fit the hand of the wearer comfortably and without strain.

It is to be noted that, in all cases, the releasability of the connecting means of this invention affords two major advantages: the boxing training gloves, regular gloves or mittens may be used normally by disconnecting the jump-rope ends; and, more importantly, it provides a safety feature in that if the rope snags or the user trips, disconnection of the rope will occur, thus reducing the hazard of injury.

Details and other features of this invention will be fully described in connection with the accompanying drawings, which are presented as illustrative examples embodying the inventive concepts claimed in this disclosure.

DRAWINGS

DESCRIPTION OF THE PREFERRED EMBODIMENTS

Figure 1:
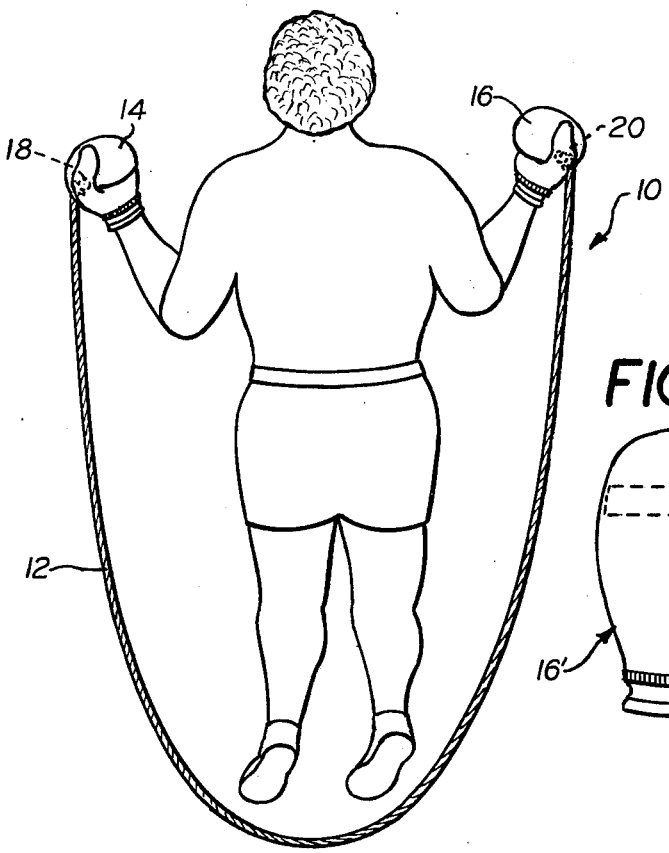
FIG. 1 is a rear view of a training boxer using a preferred form of the jump-rope device of this invention.

The jump-rope device 10 shown in use in FIG. 1 comprises jump-rope 12, boxing training gloves 14 and 16, and releasable connecting means 18 and 20. Connecting means 18 attaches one end of rope 12 to glove 14; connecting means 20 holds other end of rope 12 firmly but releasably to glove 16. The construction of device 10 is more clearly seen in FIGS. 2 and 3 where gloves 14 and 16 are each typically constructed of inner or palm-side surface layer 22, front lining layer 24, back lining layer 26, padding 28 and outer back layer 30. Fixedly mounted within each glove, between inner surface layer 22 and front lining layer 24, for example by surrounding stitching (not shown) is gripping element 32; so positioned that when the glove is in use, the hand within the glove may assume a comfortable gripping attutude suitable for punching.

Releasable connecting means 18 and 20 comprises male snap elements 34 and female socket elements 36 each of the latter being formed in gripping elements 32 and recessed so that when assembled, connecting means 18 and 20 can in no way interfere with, or cause injury to, the user of device 10.

Figure 3:
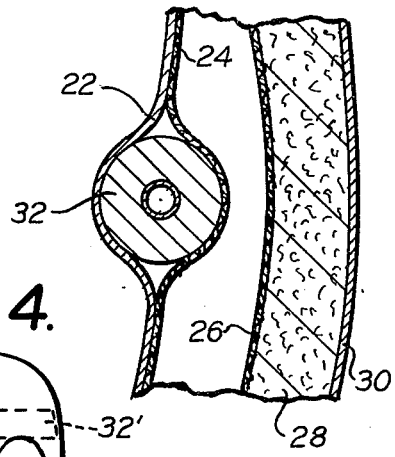
FIG. 3 is a sectional view taken along line 3—3 of FIG. 2.
Figure 4:
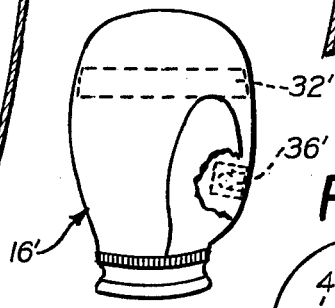
FIG. 4 is a front elevational view of a bag-punching boxing-training glove illustrating a modification of the device of FIGS. 1–3.
Figure 2:
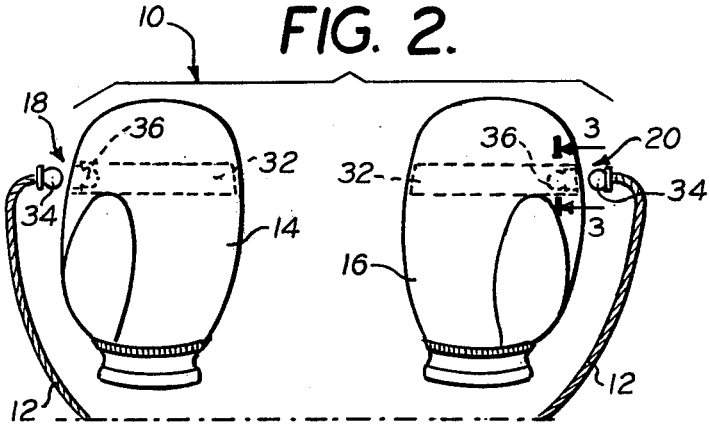
FIG. 2 is a front elevational exploded view of the device shown in FIG. 1.

FIG. 4 illustrates a modification of the device 10 of FIGS. 1–3. Here shown is one of a pair of boxing training gloves 16', which differs in that female socket 36' is an independent unit mounted within glove 16' in the area between the thumb portion and the palm portion of the glove where no conflict between the hand and socket 36' occurs. As shown, glove 16' incorporates gripping element 32', but this may be omitted if desired.

Figure 5:
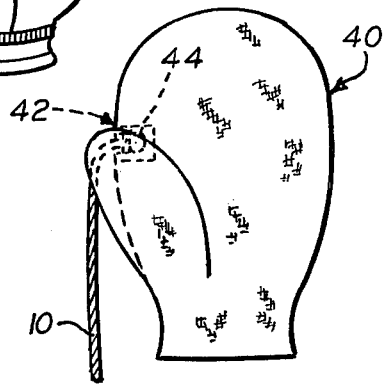
FIG. 5 shows in front elevational view another embodiment of this invention, utilizing mittens in place of the boxing-training gloves of FIGS. 1–4.

In FIG. 5, the concepts of this invention are applied to a pair of mittens (one shown). Here mitten 40 is releasably joined to one end of jump-rope 10 by connecting means 42, the female socket portion 44 of which is mounted independently within mitten 40. Obviously, mitten 40 may be fashioned alternatively with a gripping element 32-analagous to the construction of glove 14 in FIG. 2, or 14' in FIG. 4, if desired.

Figure 6:
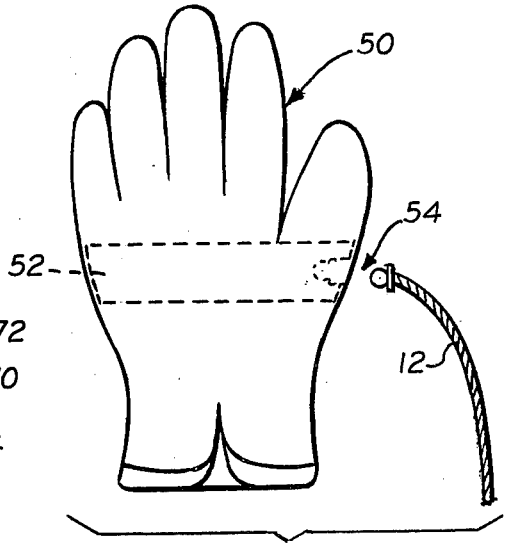
FIG. 6 is a front elevational exploded view of still another embodiment of this invention, adapting its concept for use with conventional gloves; and, FIG. 7 is an exploded partial sectional view showing a modified form of the releasable connecting means employed in this invention.

FIG. 6 shows the invention adapted to conventional style gloves, with glove 50 equipped with gripping element 52, and connecting means 54 for assembling jump-rope 12 to the gloves. As with the above-described embodiments, the inclusion of gripping elements 52 is optional.

Figure 7:
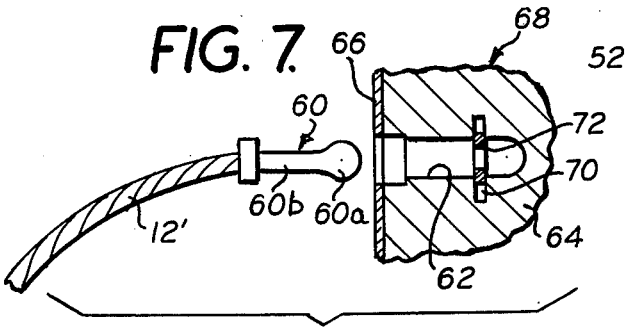

FIG. 7 illustrates an alternate form of releasable connecting means. In this embodiment, jump-rope 12' carries at each end, (not shown) an elongate jack-like male plug element 60, which mates with complementary female socket 62. Socket 62 is formed in gripping element 64, located under inner surface layer 66 of glove 68. A slot 70 transverse to socket 62 is formed in element 64 and retains split snap ring 72 but permits its radial expansion. When element 60 is inserted into socket 62, ring 72 is forced open to permit head **60*a* to pass through, then snaps into place holding around shaft 60*b*. Moderate pulling stress on rope 12' causes ring 72 to be cammed open again, permitting disconnection of rope 12' from glove 68**.

The present invention has been illustratively disclosed above; its scope is defined by the accompanying claims.

I claim:

1. Jump-rope Training-Exercise Device, which comprises, in combination:

a jump-rope;

a pair of hand-protective elements, each adapted substantially to envelop and encompass one hand of the user; and means for releasably connecting one end of said jump-rope to each of said pair of hand-protective elements.

2. The jump-rope device of claim 1, wherein said pair of hand-covering elements are boxing training gloves.

3. The jump-rope device of claim 1, wherein said pair of hand-covering elements are gloves.

4. The jump-rope device of claim 1, wherein said pair of hand-covering elements are mittens.

5. The jump-rope device of claim 1, wherein said releasable connecting means comprises:

a pair of male attachment members, one fixedly attached to each end of said jump-rope; and a pair of female attachment members, each of said female attachment members being mounted within one of said pair of hand-covering elements and being formed with a socket complementary in shape to each of said male attachment members.

6. The jump-rope device of claim 5, wherein said pair of female attachment members comprise a pair of gripping elements, one mounted inside each of said hand-covering elements and adapted to be gripped by the hand when in use, each of said gripping elements being formed with a socket complementary in shape to each of said male attachment members.

* * * * *